US005149450A

United States Patent [19]

Königs

[11] Patent Number: 5,149,450

[45] Date of Patent: Sep. 22, 1992

[54] LUBRICANT FOR TROMBONE SLIDE

[76] Inventor: Jürgen E. Königs, Walsroder Weg 18, D-4000 Düsseldorf 30, Fed. Rep. of Germany

[21] Appl. No.: 685,216

[22] Filed: Apr. 12, 1991

[30] Foreign Application Priority Data

Apr. 23, 1990 [DE] Fed. Rep. of Germany ..... 4019215

[51] Int. Cl.[5] ..... C10M 173/00; C10M 105/76; C10M 105/22

[52] U.S. Cl. ..... 252/17; 252/32; 252/49.3; 252/49.6; 252/56 R

[58] Field of Search ..... 252/17, 32, 49.3, 49.5, 252/56 R; 84/395

[56] References Cited

U.S. PATENT DOCUMENTS

| | | | |
|---|---|---|---|
| 677,965 | 7/1901 | Ennis | 84/395 |
| 2,152,396 | 3/1939 | Williams | 252/17 |
| 2,760,931 | 8/1956 | Spring et al. | 252/17 |
| 2,782,165 | 2/1957 | Peterson et al. | 252/39 |
| 3,252,906 | 5/1966 | Beretvas | 252/39 |
| 4,274,973 | 6/1981 | Stanton et al. | 252/32 |
| 4,419,254 | 12/1983 | Kosaka et al. | 252/49.6 |
| 4,491,607 | 1/1985 | Wesala | 252/49.3 |
| 4,582,616 | 4/1986 | Kita et al. | 252/39 |

OTHER PUBLICATIONS

Chemical Abstracts 103:73683e, vol. 103, 1985, p. 144, Laszlo, Hungary Patent No. 34,232, 1985.

*Primary Examiner*—Margaret Medley
*Attorney, Agent, or Firm*—Herbert Dubno; Andrew Wilford

[57] ABSTRACT

A slide of a trombone or the like is lubricated by first applying to it a layer of silicone fluid, then applying soap to the slide and thereafter spraying water on it. The silicone fluid and the soap solution are at a ratio of 1:10 to 1:20 to each other and the silicone fluid is a linear polymeric dimethylsiloxane.

8 Claims, No Drawings

LUBRICANT FOR TROMBONE SLIDE

FIELD OF THE INVENTION

The present invention relates to a lubricant for the slide of a trombone or similar musical instrument.

BACKGROUND OF THE INVENTION

In order to obtain a correct sliding movement of a trombone slides same has to be lubricated. Up to now, grease preparations, for instance on the basis of vaseline, have been used for this purpose. These lubricants have however a number of disadvantages, namely the danger is great that grease lumps form on the slide which prevent correct movement of the slide. Furthermore, lubricity is maintained only over a relative short time so that the lubricating film has to be frequently renewed. Finally, the danger exists that such a lubricant film hardens relatively quickly if the trombone is not used so that extensive cleaning efforts are necessary within relatively short times.

OBJECTS OF THE INVENTION

It is therefore an object of the present invention to provide an improved lubricant for a slide of a trombone or similar musical instrument and method of using this lubricant.

Another object is to provide a lubricant of the cited kind which has an especially long lubricity in the applied condition and which does not tend to the formation of lumps.

SUMMARY OF THE INVENTION

According to the invention this problem is solved by a lubricant which includes two components, namely silicone fluid and an aqueous soap solution which are applied to the slide one after the other in the indicated order of succession.

The inventive system of two components, if it is applied in the indicated order, i.e. first the silicone fluid or oil and thereafter the aqueous soap solution, results in a solid lubricating film whose sliding ability is preserved especially long and which is superior to the above-mentioned prior art in this respect. Furthermore, the inventive agent does not tend to the formation of lumps when applied, i.e. no local accumulations of the agent result which might have the effect of a possible braking of the associated slide. Moreover, the inventive agent does not harden as fast as corresponding preparations of a greasy basis.

Especially, the inventive agent is applied in the following manner:

Prior to the application of the agent the corresponding internal part of the slide of the trombone is cleaned of old grease, and the outer slide is also thoroughly cleaned. Thereafter, the silicone fluid or silicone oil is applied to the ends of the inner slide part. Then the silicone fluid is uniformly distributed, for instance by fitting on the outer slide and reciprocating it.

Then the aqueous soap solution is applied to the silicone fluid film, preferably to the upper end of the slide so as to run downward from the same on the silicone fluid film.

Thereafter, a thorough distribution of the soap solution follows, for instance also by movement of the slide.

Especially good results are obtained if the silicone fluid and the soap solution are applied in a ratio of 1:10 to 1:20. Thus for instance a droplet of silicone fluid is applied to the inner slide as base and is uniformly distributed on the same whereupon the aqueous soap solution is applied to the silicone fluid film in an amount corresponding to about 10 to 20 droplets and is also uniformly distributed on same.

In addition to the above-indicated advantages which can be obtained by the inventive lubricant, as for instance an especially long preservation of the lubricity, no fast loss of the lubricant, no formation of lumps and thus braking of the slide, the inventive agent has also an especially good corrosion-preventing effect.

Preferably, a silicone fluid or silicone oil is used which has a viscosity of 3 to 20 $mm^2 s^{-1}$ (cSt) at 25° C. Such a silicone fluid which is used with especially good results is a linear polymeric dimethylsiloxane. This silicone fluid is commercially obtainable under the trade name Baysilone-oil M® and is produced by the firm Bayer AG of Leverkusen, Germany.

The aqueous soap solution preferably contains dissolved fine soap. These soaps are characterized by a high content of purest fat (press tallow, olive oil etc.). They are better suited for the inventive purpose than solid soaps (hard soaps) which have a lower fat content. The kind of fine soap used is not critical; soaps which are commercially obtainable can be used.

As regards the concentration of the aqueous soap solution, especially good results can be obtained with a concentration of 125 gram soap per 6 to 7 liter water.

According to a special embodiment of the invention the lubricant contains water as third component which is applied as spray to the slide after the first and the second component. The applied water has the effect of a sliding intensifier. The corresponding amount of water which has to be applied has to be individually determined in response to the respective conditions. If necessary, spraying action has to be repeated.

Of course, each trombone slide has a different behavior according to its construction and use. Accordingly, the optimum dose of the inventive lubricant (including the dose of the individual components) has to be individually determined for the respective slide. Thus, the above-indicated ratios can only form the outer range for the use of the inventive agent.

In the following the invention is discussed in detail by means of an example.

EXAMPLE

At first, an inner slide of a trombone was treated with a conventional vaseline preparation. Prior to the application of the preparation the inner slide was cleaned of old grease by means of a paper handkerchief and lighter fluid. The outer slide was thoroughly cleaned with a cleaning rod which was wrapped around the wadding.

Then, an amount of vaseline was applied to the ends of the inner slide that after drawing up the outer slide and thorough reciprocation of the same the inner slide was covered with a uniform vaseline film.

The trombone lubricated in this manner was then used for two hours. Thereafter, an evaluation was carried out. It was observed that the vaseline had been nearly completely consumed, i.e. a uniform sliding film was no more present. Furthermore, grease lumps had formed so that "hanging" of the slide resulted.

The same trombone was then cleaned, the inner slide being cleaned of grease in the above-described manner and the associated outer slide also cleaned as described above. Then a droplet of dimethylsiloxane silicone fluid having a viscosity of 10 $mm^2 s^{-1}$ cSt at 25° C. (Baysilone oil M10) was applied to the ends of the inner slide. The outer slide was drawn up and thoroughly reciprocated.

Then, ten droplets of an aqueous soap solution (125 g commercial fine soap per 6 liter water) were applied to the inner slide in such a manner that the applied solution flowed down along the inner slide for about 10 cm on the applied silicone fluid film. The soap solution was then thoroughly distributed by movements of the slide.

Finally, water was sprayed with a spraying bottle in order to obtain a sliding-intensifying effect.

The evaluation had the result that the sliding film was still in good condition after 2 hours of use. No lumps had formed. The trombone could be used for another 2 hours without any impediments of the sliding movement. The working life of the lubricating film was about 4 hours, i.e. double that of the film of the conventional vaseline preparation.

I claim:

1. A lubricant for a slide of a trombone, the lubricant consisting of:

silicone fluid forming a base layer; and a layer of an aqueous soap solution of commercial fine soap derived from press tallow oil or olive oil lying on the base layer.

2. The lubricant defined in claim 1 wherein the silicone fluid and the soap solution are at a ratio of 1:10 to 1:20 to each other.

3. The lubricant defined in claim 1 wherein the silicone fluid is a linear polymeric dimethylsiloxane.

4. The lubricant defined in claim 1 wherein the silicone fluid has a viscosity of 3 $mm^2s^{-1}$ (cSt) at 25° C.

5. The lubricant defined in claim 1 wherein the aqueous soap solution of commercial fine soap derived from press tallow oil or olive oil has a concentration of 125 grams of soap per 6 to 7 liter of water.

6. A method of lubricating a slide of a trombone, the method comprising the steps of sequentially:

applying to the slide a base layer of silicone fluid; and thereafter applying to the slide on the silicone-fluid layer a layer of an aqueous soap solution of commercial fine soap derived from press tallow oil or olive oil.

7. The method defined in claim 6, further comprising the step of applying water to the slide after applying the soap solution thereto.

8. A lubricant for a slide of a trombone, the lubricant consisting of:

a base layer of silicone fluid; and a layer of an aqueous soap solution of commercial fine soap derived from press tallow oil or olive oil lying on the base layer and having a concentration of 125 grams of soap per 6 to 7 liter of water, the silicone fluid and the soap solution being at a ratio of 1:10 to 1:20 to each other.

* * * * *